US010527998B2

(12) United States Patent
Matsui et al.

(10) Patent No.: US 10,527,998 B2
(45) Date of Patent: Jan. 7, 2020

(54) IMAGE FORMING APPARATUS, JAM PROCESSING METHOD

(71) Applicant: CANON KABUSHIKI KAISHA, Tokyo (JP)

(72) Inventors: Noriaki Matsui, Kashiwa (JP); Nozomi Kumakura, Toride (JP); Naoka Omura, Matsudo (JP); Junichiro Nakabayashi, Kashiwa (JP); Takayuki Inoue, Matsudo (JP); Kiyoharu Kakomura, Nagareyama (JP); Yuya Ohta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 15/625,105

(22) Filed: Jun. 16, 2017

(65) Prior Publication Data

US 2018/0004147 A1 Jan. 4, 2018

(30) Foreign Application Priority Data

Jun. 29, 2016 (JP) ..... 2016-128924

(51) Int. Cl.
*G03G 15/00* (2006.01)

(52) U.S. Cl.
CPC ..... *G03G 15/70* (2013.01)

(58) Field of Classification Search
CPC ..... G03G 15/70; B65H 2220/00; B65H 2220/01; B65H 2220/02; B65H 2601/11; B65H 2601/10
See application file for complete search history.

(56) References Cited

U.S. PATENT DOCUMENTS 5,745,661 A * 4/1998 Koh ..... G03G 15/70 358/1.14
6,007,062 A * 12/1999 Choo ..... B65H 7/06 271/110
7,806,403 B2 10/2010 Matsui
2003/0122296 A1* 7/2003 Kim ..... B65H 5/06 271/3.14
2004/0184824 A1* 9/2004 Hirai ..... G03G 15/70 399/21
2006/0088323 A1* 4/2006 Morisawa ..... G03G 15/5012 399/21
2009/0317096 A1* 12/2009 Odaira ..... G03G 15/6529 399/21

(Continued)

FOREIGN PATENT DOCUMENTS

JP 2012-078604 A 4/2012

*Primary Examiner* — David H Banh
(74) *Attorney, Agent, or Firm* — Venable LLP

(57) ABSTRACT

An image forming apparatus is capable of easily performing jam processing. When an occurrence of a jam of a sheet which is conveyed on a conveying path is detected, the image forming apparatus displays a jam processing display screen which guides processing in accordance with a position where the jam has occurred. After the processing in accordance with the jam processing display screen is performed, if a state of the jam remains unchanged, the image forming apparatus performs forced feeding, which forcibly conveys the sheet to a predetermined position. The image forming apparatus displays the jam processing display screen urging to perform processing in accordance with the position of the sheet after the sheet is forcibly conveyed.

10 Claims, 15 Drawing Sheets

(56) References Cited

U.S. PATENT DOCUMENTS

| | | | | |
|---|---|---|---|---|
| 2010/0034544 | A1* | 2/2010 | Kim | G03G 15/234 399/21 |
| 2010/0278545 | A1* | 11/2010 | Hanayama | B41J 3/60 399/21 |
| 2016/0334750 | A1* | 11/2016 | Nakagaki | G03G 15/657 |

* cited by examiner

IMAGE FORMING APPARATUS, JAM PROCESSING METHOD

BACKGROUND OF THE INVENTION

Field of the Invention

The present disclosure relates to a copying machine, a multifunctional peripheral and the like, particularly, the present disclosure relates to processing technology for treating paper jamming in the same.

Description of the Related Art

In an image forming apparatus, a sheet stored in a sheet feeding cassette is taken in. While conveying the sheet, the image forming apparatus forms an image on the sheet. At this time, paper clogging (hereinafter referred to as "jam") is sometimes caused on a conveying path. Depending on a stop position of the sheet at the occurrence of the jam, a user sometimes finds it difficult to perform jam processing. For example, this includes a case when the jam occurs immediately after the sheet is fed from the sheet feeding cassette and a leading edge of the sheet hardly comes out from the sheet feeding cassette. In this case, even if the user opens a door provided on a side surface of the image forming apparatus main body to remove the sheet, a user's hand is difficult to reach the sheet, which makes it difficult to perform the jam processing.

A method to convey a sheet to a position where the jam processing is easily performed at an occurrence of the jam is known. However, the sheet cannot sometimes be conveyed to a position where the jam processing is easily performed due to collision between sheets caused when a space with a preceding sheet which has stopped at the occurrence of the jam is narrow. An image forming apparatus as disclosed in Japanese Patent Application Laid-open No. 2012-78604 discloses a technology for forcibly conveying a sheet by a predetermined amount in accordance with a size and a type of the sheet after the door provided on a side surface of the image forming apparatus main body is opened at an occurrence of a jam. By delivering a leading edge of a subsequent sheet in an open space of the opened door, even in a case where the space with the preceding sheet is narrow, the user can easily perform the jam processing.

Some image forming apparatuses comprise a fixing conveyance unit in which a conveying unit for conveying a sheet is integrated with a fixing device for fixing an image on the sheet. When the jam occurs in a conveying unit part of the fixing conveyance unit, by opening a front door provided on a front surface of the image forming apparatus main body and drawing out the fixing conveyance unit, the sheet can be removed.

A conveying path of the fixing conveyance unit is connected to a conveying path provided in the image forming apparatus main body. The conveying path provided in the image forming apparatus main body includes a conveying path for conveying the sheet to the fixing conveyance unit and a conveying path for delivering the sheet outside the image forming apparatus from the fixing conveyance unit. The conveying path for conveying the sheet to the fixing conveyance unit includes a conveying path for conveying the sheet fed from the sheet feeding cassette to the fixing conveyance unit and a conveying path for conveying the sheet fed from an external optional deck to the fixing conveyance unit. When the jam occurs between the conveying path of the fixing conveyance unit and the conveying path of a main body frame of the image forming apparatus, the jammed sheet straddles between the conveying path of the fixing conveyance unit and the conveying path of the image forming apparatus main body, with a portion of the jammed sheet being on the conveying path of the fixing conveyance unit and the other portion of the jammed sheet being on the conveying path of the image forming apparatus main body. When the fixing conveyance unit is drawn out in this state, the sheet is torn into parts, in particular, a part remaining on the conveying path of the image forming apparatus main body and a part on the conveying path of the fixing conveyance unit. In the following, a state in which the sheet is torn in this manner is referred to as "sheet torn off". Due to "sheet torn off",the sheet is torn, which creates a sheet piece. Removing the sheet piece is not easy. The sheet piece which is not removed but remains causes a new jam.

There are some patterns in which the jam occurs between the conveying path of the fixing conveyance unit and the conveying path of the main body frame of the image forming apparatus. For example, the jam occurs when, in the jam processing performed when a plurality of sheets is overlappingly conveyed, only one sheet can be taken out. The jam also occurs when a sheet is retained due to an instantaneous disconnection of a power and when the sheet cannot be grabbed at the time of the jam processing and the like. There is a method to forcibly deliver the jammed sheet to an exclusive delivery tray (escape tray, purge tray), however, this has a problem in terms of cost. Thereby, an image forming apparatus capable of easily performing the jam processing is desired.

SUMMARY OF THE INVENTION

An image forming apparatus according to the present disclosure includes a conveyer configured to convey a sheet on a conveying path; a jam detector configured to detect a jam of a sheet which is conveyed by the conveyer; a display configured to display information; and a controller configured to perform control for jam processing if a jam is detected by the jam detector, wherein the controller performs following functions: a first display function to display first jam processing information on the display, the first jam processing information representing a processing procedure for releasing a jam in accordance with a position where the jam occurs; a forcibly feeding function to forcibly convey the sheet to a predetermined position by the conveyer if, after processing for releasing a jam in accordance with the first jam processing information is performed, a state of the jam remains unchanged; and a second display function to display second jam processing information on the display, the second jam processing information representing a processing procedure for releasing a jam in accordance with the predetermined position after a sheet is conveyed by the forcibly feeding function.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

Configuration

Figure 1:
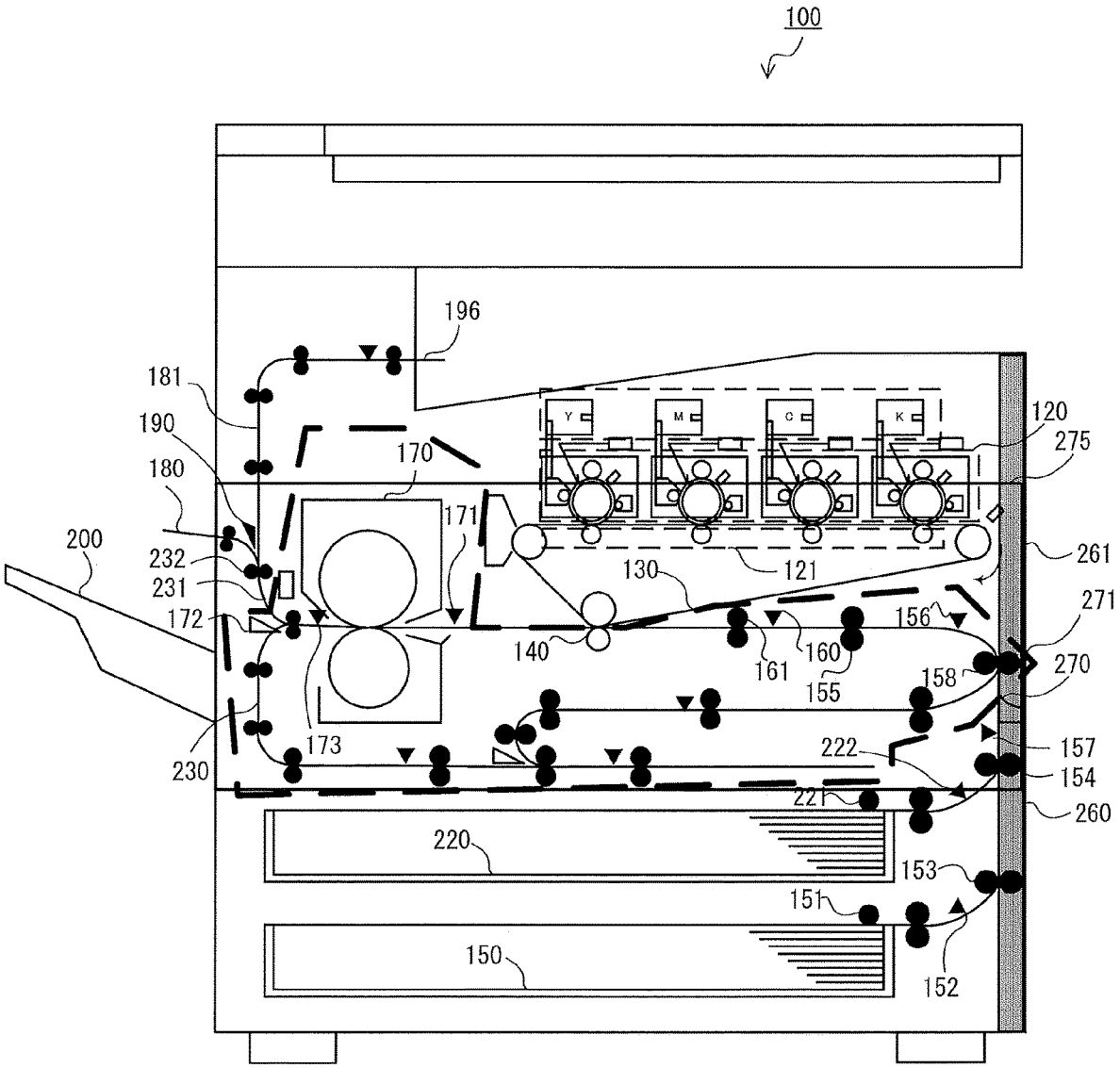
FIG. 1 is a configuration diagram of an image forming apparatus.

FIG. 1 is a configuration diagram of an image forming apparatus according to the present embodiment. The image forming apparatus 100 comprises a process unit 120, a primary transfer part 121, a transfer belt 130, a secondary transfer part 140, a fixing conveyance unit 271, a first sheet feeding cassette 150, and a second sheet feeding cassette 220. The image forming apparatus 100 is configured to allow sheet feeding via an optional deck conveying path 270 from an optional deck which is an external unit. A front door 275 is provided on a front surface of the image forming apparatus 100 main body. A right lower door 260 and a right upper door 261 are provided on a side surface of the image forming apparatus 100 main body. For example, the front door 275, the right lower door 260, and the right upper door 261 are opened to remove the sheet remaining in the main body at the occurrence of the jam. When the front door 275 is opened, the fixing conveyance unit 271 is allowed to be drawn out to a front side of the image forming apparatus 100 main body.

The process unit 120 forms a toner image by performing image forming processing. The process unit 120 comprises a photosensitive drum, a charging roller, an exposure device, a developing device, and a photosensitive drum cleaner. A surface of the photosensitive drum is charged by the charging roller. Thereafter, by laser beam irradiated from the exposure device, an electrostatic latent image is formed on the surface of the photosensitive drum. By adhering toner on the surface of the photosensitive drum, the developing device develops the electrostatic latent image. A toner image is thereby formed on the surface of the photosensitive drum. The toner image is transferred to the transfer belt 130 by the primary transfer part 121. The toner remaining on the photosensitive drum after the transfer is removed by the photosensitive drum cleaner. The transfer belt 130 is rotating and conveys the transferred toner image to the secondary transfer part 140.

The first sheet feeding cassette 150 and the second sheet feeding cassette 220 store sheets on which images are formed. The sheets stored in the first sheet feeding cassette 150 are fed one by one by a first pickup roller 151 and conveyed along the conveying path to the fixing conveyance unit 271 by conveying rollers 153 and 154. A pickup sensor 152 is provided between the first pickup roller 151 and the conveying roller 153. The sheets stored in the second sheet feeding cassette 220 are fed one by one by a second pickup roller 221 and conveyed along the conveying path to the fixing conveyance unit 271 by the conveying roller 154. A pickup sensor 222 is provided between the second pickup roller 221 and the conveying roller 154. A vertical path sensor 157 is provided between the conveying roller 154 and the fixing conveyance unit 271. The conveying path from the first sheet feeding cassette 150 and the second sheet feeding cassette 220 to the fixing conveyance unit 271 is formed in the main body frame of the image forming apparatus 100. Preferably, each sensor is provided at intervals according to a length of a sheet conveying direction.

The fixing conveyance unit 271 is configured to integrate a conveying unit for conveying a sheet with a fixing device for fixing an image on the sheet. The fixing conveyance unit 271 comprises conveying rollers 158 and 155 and a registration roller 161 on the conveying path for conveying the sheet. The secondary transfer part 140 is provided on the conveying path. A fixing device 170 is provided downstream of a conveying direction of the secondary transfer part 140. The fixing conveyance unit 271 comprises a sheet conveying path 230 for bringing the sheet back to the conveying roller 158 from downstream of the conveying direction of the fixing device 170. A conveyance sensor 156 is provided between the conveying roller 158 and the conveying roller 155. A registration sensor 160 is provided between the conveying roller 155 and the registration roller 161. A sheet conveyance sensor 171 is provided between the secondary transfer part 140 and the fixing device 170. A fixing outlet sensor 173 is provided on a downstream side of the conveying direction of the fixing device 170. The conveying path of the fixing conveyance unit 271 connects to the conveying path from the first cassette 150 and the second cassette 220 to the fixing conveyance unit 271 on an upstream side of the conveying direction. Preferably, each sensor is provided at intervals according to a length of a sheet conveying direction.

A conveyance flapper 172 is provided downstream of the conveying direction of the fixing device 170. The conveying path of the fixing conveyance unit 271 connects to a sheet conveying path 231 on a downstream side of the conveying direction. The conveyance flapper 172 conveys the sheet to the sheet conveying path 230 or the sheet conveying path 231. For example, when double-side printing is performed, the conveyance flapper 172 conveys the sheet to the sheet conveying path 230. When delivering the sheet outside the image forming apparatus 100, the conveyance flapper 172 conveys the sheet to the sheet conveying path 231.

The sheet conveying path 231 comprises a conveying roller 232 and conveys the sheet conveyed from the fixing conveyance unit 271 to the sheet conveying path 180 or the sheet conveying path 181. Thereby, a conveyance flapper 190 is provided on a downstream side of the conveying path of the conveying roller 232. When delivering the sheet to a delivery tray 200, the conveyance flapper 190 conveys the sheet to the sheet conveying path 180. When delivering the sheet to a delivery tray 196, the conveyance flapper 190 conveys the sheet to the sheet conveying path 181. The sheet conveying paths 231, 180, and 181 are conveying paths formed in the main body frame of the image forming apparatus 100.

Figure 2:
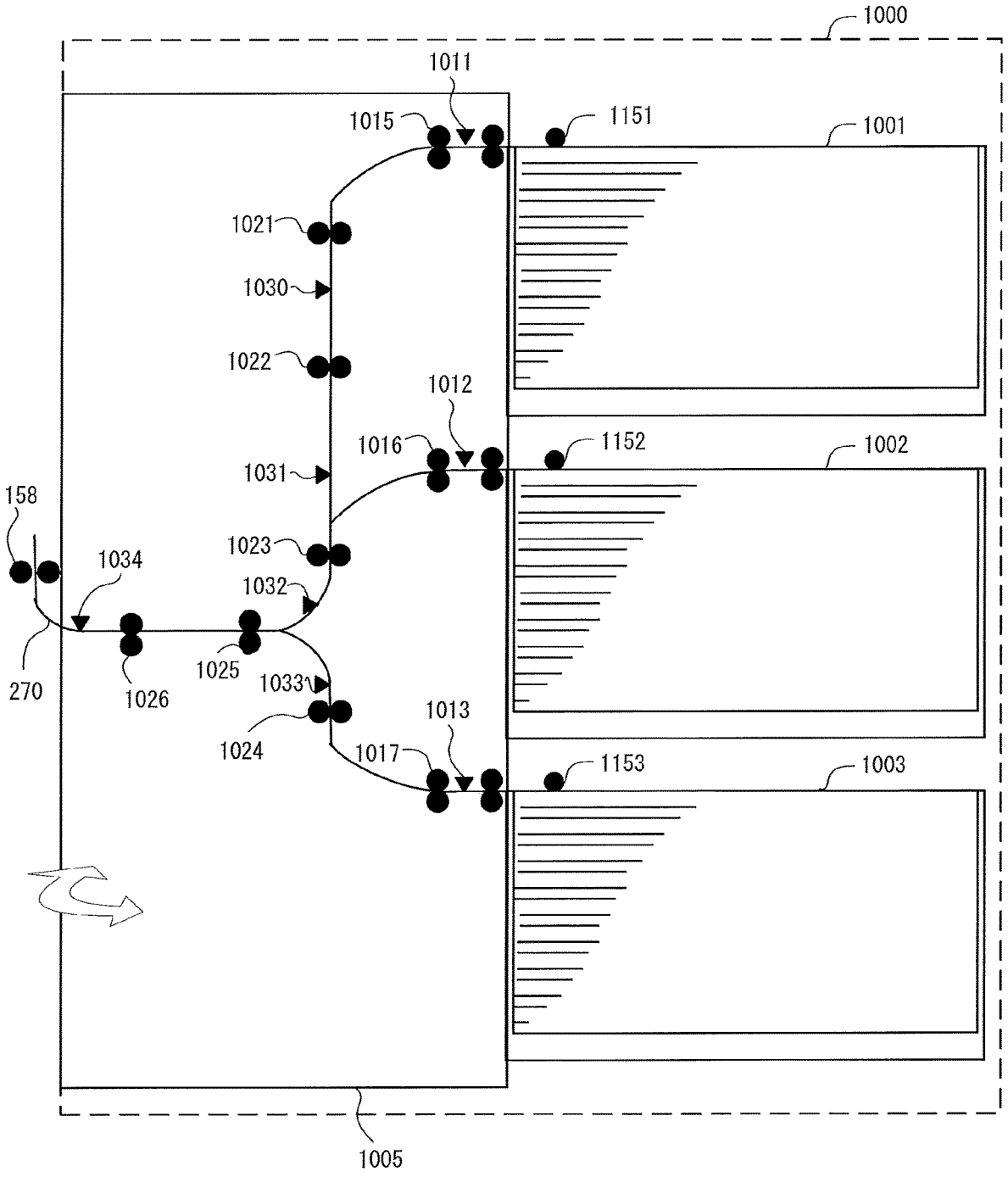
FIG. 2 is a configuration diagram of an optional deck.

FIG. 2 is a configuration diagram of an optional deck which feeds the sheet to the image forming apparatus 100. An optional deck 1000 is connected to a right side surface of the image forming apparatus 100 shown in FIG. 1. The optional deck 1000 comprises a three-stage sheet feeding part consisting of an upper stage sheet feeding part 1001, a middle stage sheet feeding part 1002, and a lower stage sheet feeding part 1003. The sheets stored in the upper stage sheet feeding part 1001 are fed one by one by a pickup roller 1151. Each sheet is then supplied to the image forming apparatus 100 from the optional deck conveying path 270 through an upper stage conveying path and a common conveying path. The sheets stored in the middle stage sheet feeding part 1002 are fed one by one by a pickup roller 1152. Each sheet is then supplied to the image forming apparatus 100 from the optional deck conveying path 270 through a middle stage conveying path and the common conveying path. The sheets stored in the lower stage sheet feeding part 1003 are fed one by one by a pickup roller 1153. Each sheet is then supplied to the image forming apparatus 100 from the optional deck conveying path 270 through a lower stage conveying path and the common conveying path. A multistage door 1005 is provided on a front side of the optional deck 1000. By turning the multistage door 1005 to a front right side, the multistage door 1005 is opened. The user is allowed to access the upper stage conveying path, the middle stage conveying path, the lower stage conveying path, and the common conveying path when the multistage door 1005 is opened.

The upper stage conveying path is provided with a pulling out roller 1015 and OPT conveying rollers 1021, 1022, and 1023 in order from the upper stage sheet feeding part 1001 side. An OPT sheet feeding sensor 1011 is provided between the upper stage sheet feeding part 1001 and the pulling out roller 1015. An OPT conveyance sensor 1030 is provided between the OPT conveying roller 1021 and the OPT conveying roller 1022. An OPT conveyance sensor 1031 is provided between the OPT conveying roller 1022 and the OPT conveying roller 1023. Each sensor is provided between each roller.

The middle stage conveying path is provided with a pulling out roller 1016 and the OPT conveying roller 1023 in order from the middle stage sheet feeding part 1002 side. The OPT conveying roller 1023 is used in common on the upper stage conveying path and the middle stage conveying path. An OPT sheet feeding sensor 1012 is provided between the middle stage sheet feeding part 1002 and the pulling out roller 1016.

The lower stage conveying path is provided with a pulling out roller 1017 and an OPT conveying roller 1024 in order from the lower stage sheet feeding part 1003 side. An OPT sheet feeding sensor 1013 is provided between the lower stage sheet feeding part 1003 and the pulling out roller 1017.

The common conveying path is provided with an OPT conveying roller 1025 and an OPT conveying roller 1026 in order from the upper stage conveying path, the middle stage conveying path, and the lower stage conveying path sides. An OPT conveyance sensor 1032 is provided between the OPT conveying roller 1023 and the OPT conveying roller 1025. The common conveying path connects to the optional deck conveying path 270 on a downstream side of the conveying direction. The sheet conveyed to a front end of the optional deck conveying path 270 is drawn into the image forming apparatus 100 by the conveying roller 158 of the fixing conveyance unit 271. An OPT conveyance sensor 1034 is provided between the common conveying path and the optional deck conveying path 270.

Figure 3:
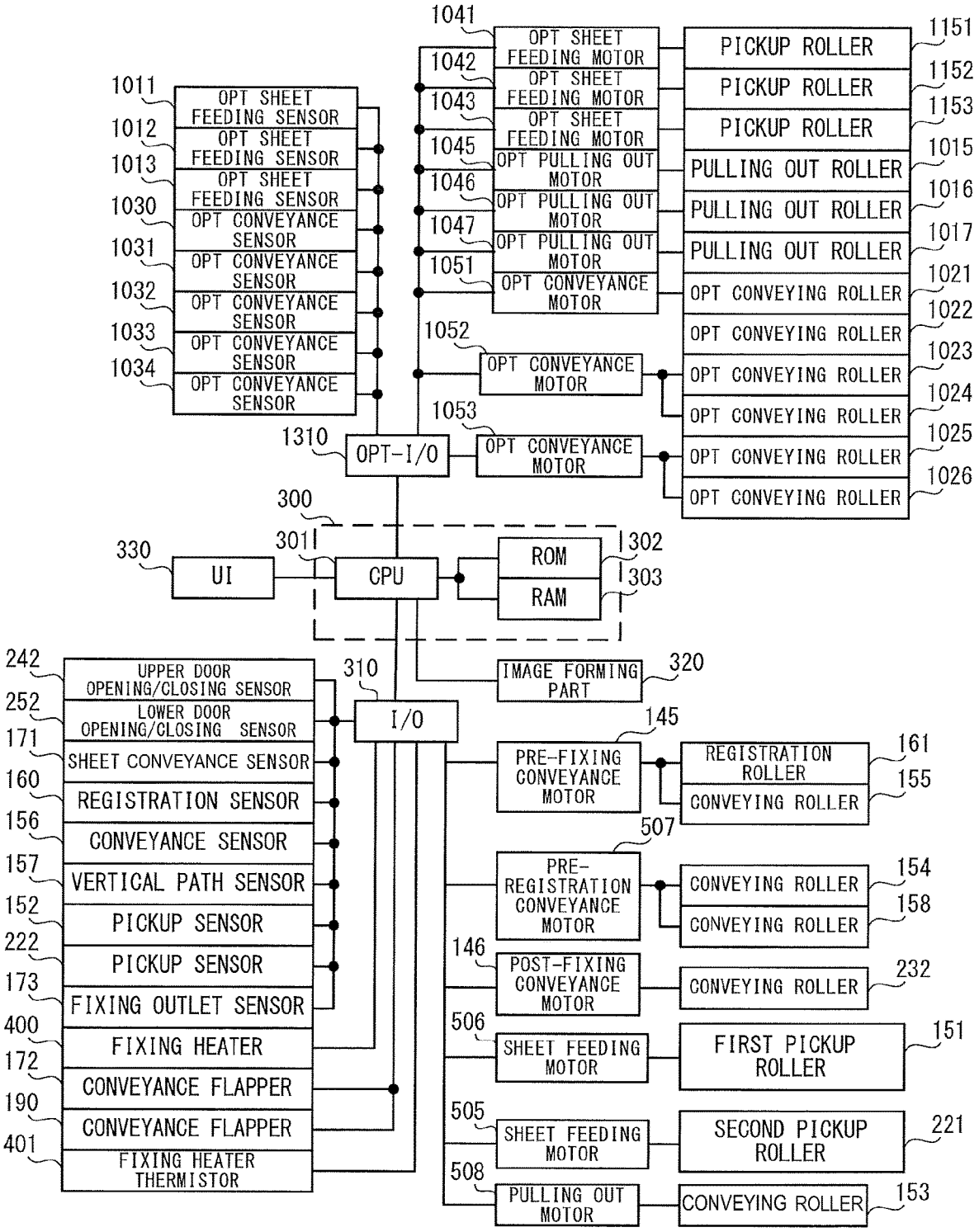
FIG. 3 is a configuration diagram of a control part.

FIG. 3 is a configuration diagram of a control part which controls operation of the image forming apparatus 100 and the optional deck 1000. For example, a control part 300 is incorporated in the image forming apparatus 100. The control part 300 is connected to an UI part 330 as an operation part, an I/O 310 as an interface with each part of the image forming apparatus 100, an OPT-I/O 1310 as an interface with each part of the optional deck 1000.

The UI part 330 is a user interface comprising an input button, a display, a touch panel and the like. The UI part 330 transmits various instructions such as instruction to start printing operation and settings which are input through an input device such as the input button, the touch panel and the like to the control part 300. Through the control part 300, the UI part 330 displays an instruction and an image such as an input image on an output device such as the display. In particular, in the present embodiment, a jam processing display screen (described later) which is jam processing information for urging the user to perform the jam processing is displayed on the display of the UI part 330. When the jam processing information is informed (the jam processing display screen is guided), how to perform the jam processing is guided to the user.

The control part 300 is a computer system comprising a central processing unit (CPU) 301, a read only memory (ROM) 302 and a random access memory (RAM) 303. The CPU 301 controls the operation of the image forming apparatus 100 and the optional deck 1000 by reading computer program from the ROM 302 and executing the computer program using the RAM 303 as a work area.

The CPU 301 performs drive control of various motors of the image forming apparatus 100 connected via the I/O 310. Motors of the image forming apparatus 100 include a pre-fixing conveyance motor 145, a pre-registration conveyance motor 507, a post-fixing conveyance motor 146, sheet feeding motors 505 and 506, a pulling out motor 508 and the like. The pre-fixing conveyance motor 145 drives the registration roller 161 and the conveying roller 155. The pre-registration conveyance motor 507 drives the conveying rollers 154 and 158. The post-fixing conveyance motor 146 drives the conveying roller 232. The sheet feeding motor 505 drives the second pickup roller 221. The sheet feeding motor 506 drives the first pickup roller 151. The pulling out motor 508 drives the conveying roller 153.

The CPU 301 obtains detection results of various sensors of the image forming apparatus 100 connected via the I/O 310. Sensors of the image forming apparatus 100 include the sheet conveyance sensor 171, the fixing outlet sensor 173, the registration sensor 160, the pickup sensors 152 and 222, an upper door opening/closing sensor 242, a lower door opening/closing sensor 252, the conveyance sensor 156, the vertical path sensor 157, and the like. The sheet conveyance sensor 171, the fixing outlet sensor 173, the registration sensor 160, the pickup sensors 152 and 222, the conveyance sensor 156, and the vertical path sensor 157 detect presence/absence of the sheet at positions where they are respectively arranged. The upper door opening/closing sensor 242 detects opening/closing of the right upper door 261 of the image forming apparatus 100. The lower door opening/closing sensor 252 detects opening/closing of the right lower door 260 of the image forming apparatus 100.

When forming an image, the CPU 301 controls operation of a fixing heater 400 and the conveyance flappers 172 and 190 via the I/O 310 while controlling operation of an image forming part 320. The image forming part 320 performs high pressure control and driving control of the process unit 120, the transfer belt 130, the secondary transfer part 140 and the like and performs operation control of an exposure part. The CPU 301 obtains a heater temperature detected by a fixing heater thermistor 401 via the I/O 310 and performs temperature control of the fixing heater 400 according to the heater temperature.

The CPU 301 performs driving control of various motors of the optional deck 1000 via the OPT-I/O 1310. Motors of the optional deck 1000 include OPT sheet feeding motors 1041, 1042 and 1043, OPT pulling out motors 1045, 1046, and 1047, and OPT conveyance motors 1051, 1052, and 1053 and the like. The OPT sheet feeding motor 1041 drives the pickup roller 1151. The OPT sheet feeding motor 1042 drives the pickup roller 1152. The OPT sheet feeding motor 1043 drives the pickup roller 1153. The OPT pulling out motor 1045 drives the pulling out roller 1015. The OPT pulling out motor 1046 drives the pulling out roller 1016. The OPT pulling out motor 1047 drives the pulling out roller 1017. The OPT conveyance motor 1051 drives the OPT conveying rollers 1021 and 1022. The OPT conveyance motor 1052 drives the OPT conveying rollers 1023 and 1024. The OPT conveyance motor 1053 drives the OPT conveying rollers 1025 and 1026.

The CPU 301 obtains detection results of various sensors of the optional deck 1000 connected via the OPT-I/O 1310. Sensors of the optional deck 1000 include the OPT sheet feeding sensors 1011, 1012, and 1013, and OPT conveyance sensors 1030, 1031, 1032, 1033, and 1034 and the like. These sensors detect presence/absence of the sheet at positions where they are respectively arranged.

Operation

Through the input of the printing operation start instruction from the UI part 330 and the like, the image forming apparatus 100 having the configuration as mentioned performs the operation control for forming the image through the CPU 301.

The CPU 301 rotationally drives the first pickup roller 151 with the sheet feeding motor 506 through the I/O 310. Thereby, the sheets stored in the first sheets feeding cassette 150 are fed one by one. The CPU 301 monitors the sheet feeding operation by the pickup sensor 152. It is noted that when the sheet is fed from the second sheet feeding cassette 220, the CPU 301 rotationally drives the second pickup roller 221 with the sheet feeding motor 505 and monitors the sheet feeding operation by the pickup sensor 222.

In accordance with a timing at which the sheet reaches the secondary transfer part 140, the CPU 301 controls toner image forming operation by the process unit 120 by the image forming part 320. The toner image formed by the process unit 120 is transferred to the transfer belt 130 by the primary transfer part 121. The transfer belt 130 is rotationally driven and conveys the transferred toner image to the secondary transfer part 140.

The CPU 301 rotationally drives the conveying roller 153 with the pulling out motor 508 through the I/O 310. The sheet thus fed is conveyed along the conveying path to the fixing conveyance unit 271. The CPU 301 rotationally drives the conveying rollers 154 and 158 with the pre-registration conveyance motor 507 through the I/O 310. Thereby, the sheet is conveyed in the fixing conveyance unit 271. The CPU 301 rotationally drives the conveying roller 155 and the registration roller 161 with the pre-fixing conveyance motor 145 through the I/O 310. Thereby, the sheet is conveyed to the secondary transfer part 140. The CPU 301 monitors the sheet conveyed by the conveying rollers 153, 154, 155, 158 by the vertical path sensor 157, the conveyance sensor 156, and the registration sensor 160. In accordance with a timing at which the registration sensor 160 detects the leading edge of the sheet, the CPU 301 controls conveyance of the sheet so that the leading edge of the sheet matches with a leading edge of the toner image on the transfer belt 130 at the second transfer part 140. For example, in a case where the sheet has reached faster than the toner image, the sheet is stopped for a predetermined time with the registration roller 161 and thereafter, the conveyance of the sheet is resumed.

By applying a secondary transfer voltage to the sheet and the toner image on the transfer belt 130, the secondary transfer part 140 transfers the toner image to the sheet. The sheet after the second transfer is conveyed to the fixing device 170. The CPU 301 controls the temperature of the fixing heater 400 to a predetermined temperature in accordance with detection result of the fixing heater thermistor 401 through the I/O 310. Thereby, the fixing device 170 can surely heat and fix the toner image on the sheet. The sheet on which the image has been fixed is conveyed to downstream of the conveying path.

The CPU 301 determines which one to convey the sheet, the sheet conveying path 230 or the sheet conveying path 231 in accordance with contents previously set by the UI part 330 at timing at which the fixing outlet sensor 173 detects the leading edge of the sheet on which the image has been fixed and sets the conveyance flapper 172. In particular, in a case where double-sided printing is set, the CPU 301 sets the conveyance flapper 172 to convey the sheet to the sheet conveying path 230. In a case where one-sided printing is set or the image formation on a back surface of the double-sided printing is finished, the CPU 301 sets the conveyance flapper 172 to convey the sheet to the sheet conveying path 231. The sheet conveyed to the sheet conveying path 230 is conveyed to the conveying roller 158 and the image formation on the back surface is performed.

The sheet conveyed to the sheet conveying path 231 is conveyed to the conveying roller 232 which is driven by the post-fixing conveyance motor 146 in accordance with the control of the CPU 301. The CPU 301 determines which one to convey the sheet, the sheet conveying path 180 or the sheet conveying path 181 in accordance with contents previously set by the UI part 330 and sets the conveyance flapper 190. In a case where the delivery tray 200 is set as a delivery destination by the UI part 330, the CPU 301 sets the conveyance flapper 190 to convey the sheet to the sheet conveying path 180. In a case where the delivery tray 196 is set as the delivery destination by the UI part 330, the CPU 301 sets the conveyance flapper 190 to convey the sheet to the sheet conveying path 181.

In the following, a description is provided with regard to sheet feeding operation from the optional deck 1000. Here, the description is provided in a case where the sheet is fed from the upper stage sheet feeding part 1001 of the optional deck 1000. It is noted that the same operation is performed in the middle stage sheet feeding part 1002 and the lower stage sheet feeding part 1003.

The CPU 301 rotationally drives the pickup roller 1151 with the OPT sheet feeding motor 1041 as a driving source through the OPT-I/O 1310. Thereby, the sheets stored in the upper stage sheet feeding part 1001 are fed one by one. The CPU 301 monitors the sheet feeding operation by the OPT sheet feeding sensor 1011 through the OPT I/O 1310.

The CPU 301 rotationally drives the pulling out roller 1015 with the OPT pulling out motor 1045 through the OPT I/O 1310. The CPU 301 rotationally drives the OPT conveying rollers 1021 and 1022 with the OPT conveyance motor 1051 through the OPT I/O 1310. The CPU 301 rotationally drives the OPT conveying roller 1023 with the OPT conveyance motor 1052 through the OPT I/O 1310. The sheet thus fed is conveyed along the upper-stage conveying path to the common conveying path. The CPU 301 monitors the position of the sheet conveyed along the upper-stage conveying path by the OPT conveying rollers 1021, 1022, and 1023 by the OPT conveyance sensors 1030, 1031, and 1032 through the OPT-I/O 1310.

The CPU 301 rotationally drives the OPT conveying rollers 1025 and 1026 with the OPT conveyance motor 1053 through the OPT-I/O 1310. The sheet conveyed from the upper stage conveying path is conveyed along the common conveying path to the optional deck conveying path 270. The CPU 301 monitors the position of the sheet conveyed along the common conveying path by the OPT conveying rollers 1025 and 1026 by the OPT conveyance sensor 1034 through the OPT-I/O 1310. The sheet is supplied inside the fixing conveyance unit 271 of the image forming apparatus 100 via the optional deck conveying path 270.

Jam Detection

Figure 4:
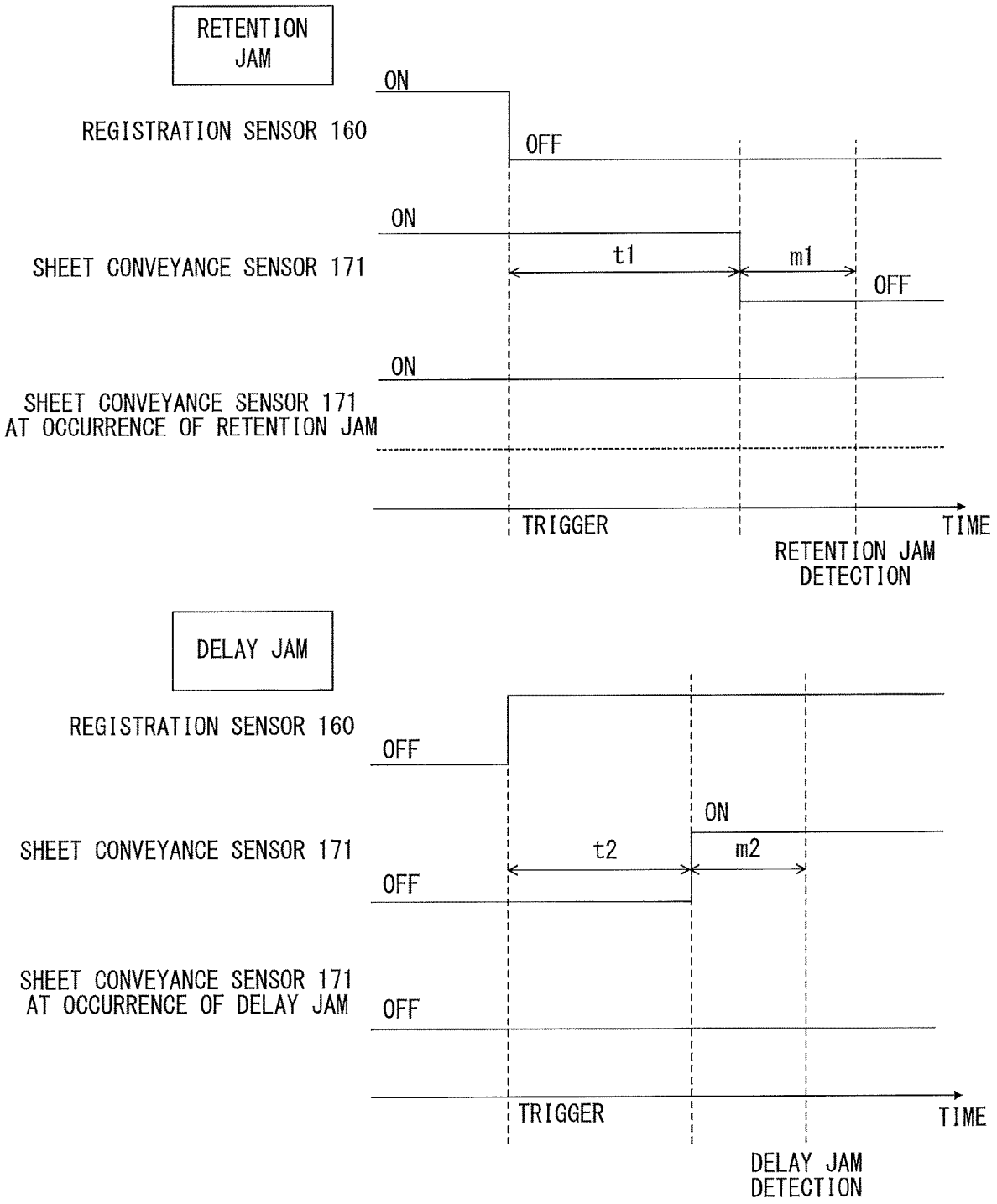
FIG. 4 is an explanatory diagram of detection processing when a jam has occurred.

FIG. 4 is an explanatory diagram of detection processing when a jam has occurred to a sheet which is being conveyed. Here, a description is provided in a case where the jam of the sheet is detected in the sheet conveyance sensor 171 based on sheet detection timing at the registration sensor 160 and the sheet conveyance sensor 171 arranged downstream of its conveying direction. By performing similar detection processing, it is possible to detect the occurrence of the jam between two neighboring sensors on the conveying path. The jam detected here is the jam caused by retention of the sheet (hereinafter referred to as "retention jam") and the jam caused by a delay of the sheet (hereinafter referred to as "delay jam"). The control part 300 continuously performs the jam detection processing during the image forming processing.

The retention jam detection processing is performed when the registration sensor 160 detects a passage of a rear end of the sheet being conveyed, which is used as a trigger. From the occurrence timing of the trigger, a distance between the registration sensor 160 and the sheet conveyance sensor 171, and a sheet conveying speed, time t1 is calculated. The time t1 is a time when the rear end of the sheet is predicted to pass the sheet conveyance sensor 171. The control part 300 sets time taking into consideration of degradation of conveyance efficiency due to wear of the conveying roller and configuration of the conveying mechanism itself as conveyance margin m1. The control part 300 predicts that it takes (t1+m1) time from the passage of the registration sensor 160 to the detection of the rear end of the sheet by the sheet conveyance sensor 171. The control part 300 determines that the retention jam has occurred in a case where the sheet conveyance sensor 171 does not detect the rear end of the sheet even after (t1+m1) time has elapsed.

The delay jam detection processing is performed when the registration sensor 160 detects reach of the leading edge of the sheet being conveyed, which is used as a trigger. From the occurrence timing of the trigger, a distance between the registration sensor 160 and the sheet conveyance sensor 171, and the sheet conveying speed, time t2 is calculated. The time t2 is a time when the leading edge of the sheet is predicted to reach the sheet conveyance sensor 171. The control part 300 sets time taking into consideration of the degradation of the conveyance efficiency due to the wear of the conveying roller and the configuration of the conveying mechanism itself as conveyance margin m2. The control part 300 predicts that it takes (t2+m2) time from the reach of the leading edge of the sheet to the registration sensor 160 to the reach of the leading edge of the sheet to the sheet conveyance sensor 171. The control part 300 determines that the delay jam has occurred in a case where the sheet conveyance sensor 171 does not detect the leading edge of the sheet even after (t2+m2) time has elapsed.

Processing at an Occurrence of a Jam

Figure 5:
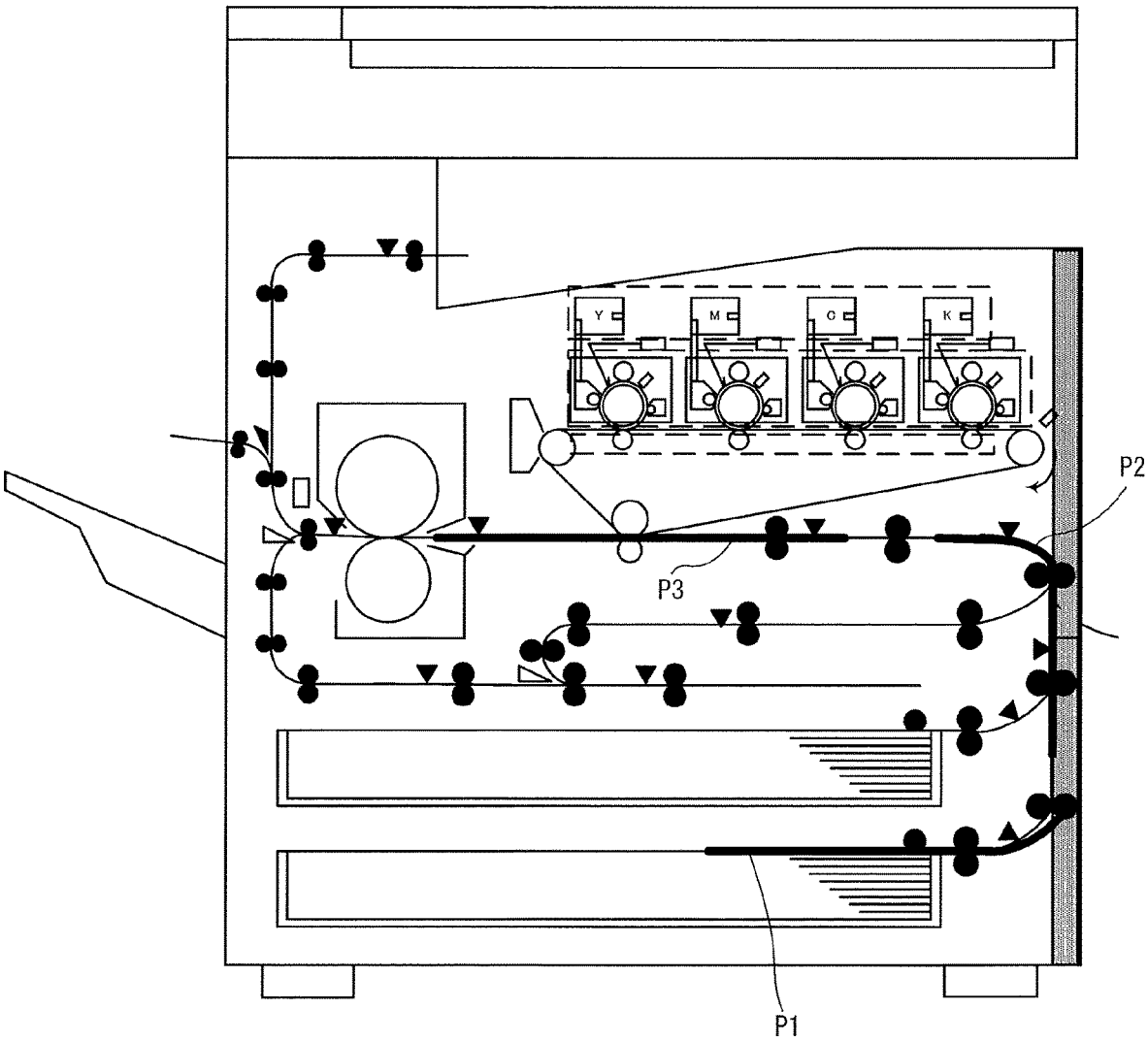
FIG. 5 is an illustration diagram of a state of a sheet in the image forming apparatus at an occurrence of a jam.

FIG. 5 is an illustration diagram of a state of the sheet in the image forming apparatus 100 at an occurrence of a jam. Here, the jam is caused by a sheet P2. A sheet P1, positioned upstream of the conveying direction of the sheet P2, is a remaining sheet. Conveyance of the sheet P1 is stopped due to the occurrence of the jam. A sheet P3 is positioned downstream of the conveying direction of the sheet P2. Conveyance of the sheet P3 is normally continued. Then, the sheet P3 is delivered outside the image forming apparatus 100. The control part 300 urges the user to perform the jam processing when processing to all sheets being conveyed including stop of conveyance of the sheet P1, delivery of the sheet P3 and the like is finished.

Figure 6:
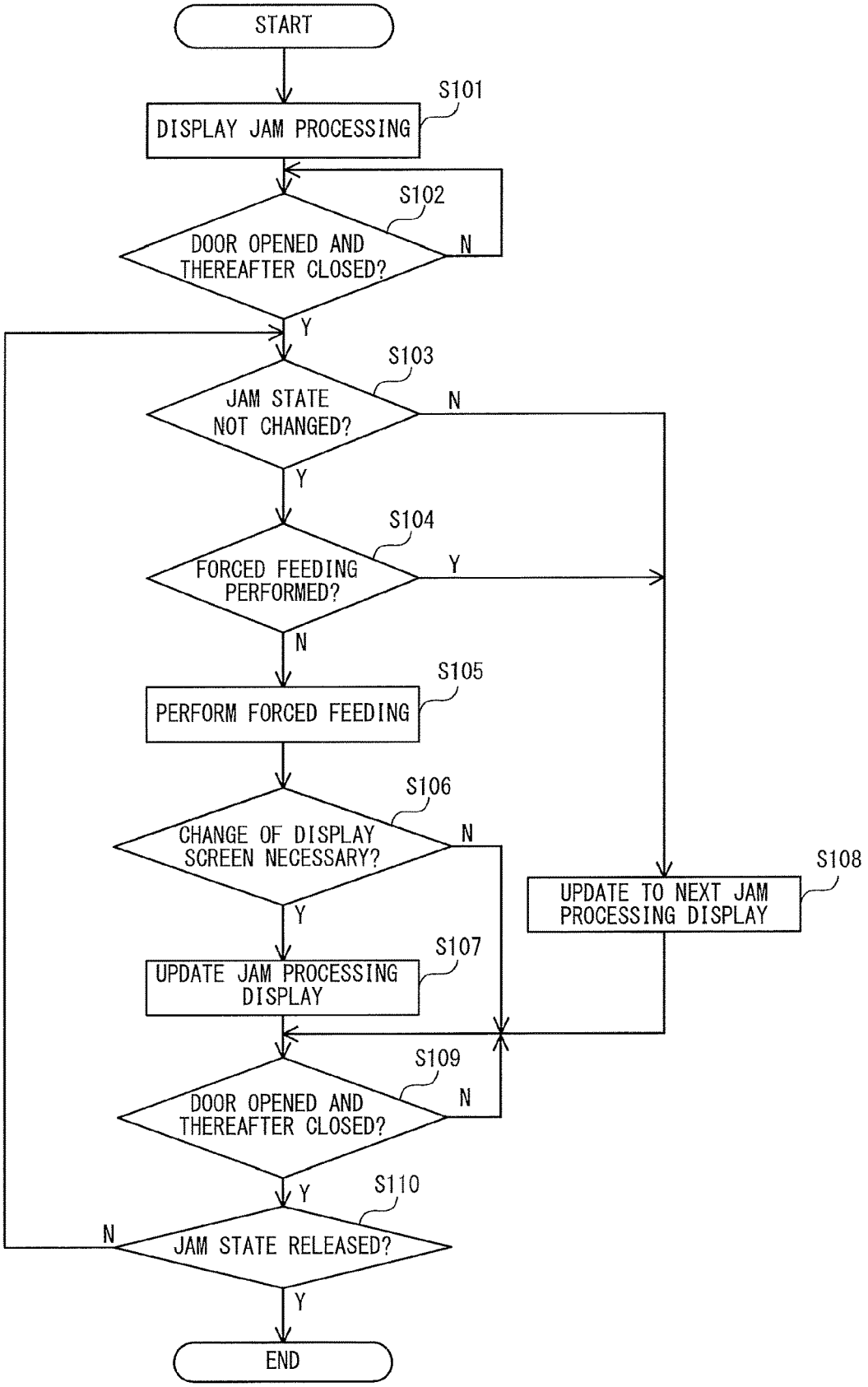
FIG. 6 is a flowchart showing jam processing.

FIG. 6 is a flowchart showing jam processing for dissolving a jam at an occurrence of the jam which is performed by the CPU 301.

In a case where the sheet stops in a state in which the sheet straddles between the conveying path of the fixing conveyance unit 271 and the conveying path of the main body frame of the image forming apparatus 100, when the jam processing of opening the front door 275 to draw out the fixing conveyance unit 271 of the image forming apparatus 100 is performed, "sheet torn off" may be induced. Because of this, the image forming apparatus 100 guides the jam processing to the user when removing the remaining sheet caused by the jam by opening the front door 275, the right lower door 260, and the right upper door 261 of the main body. The state in which the sheet straddles between the conveying path of the fixing conveyance unit 271 and the conveying path of the main body frame of the image forming apparatus 100 means a state in which both the conveyance sensor 156 in the fixing conveyance unit 271 and the vertical path sensor 157 of the main body frame of the image forming apparatus 100 are detecting the sheet. Further, a state in which both the conveyance sensor 156 and the OPT conveyance sensor 1034 of the optional deck 1000 are detecting the sheet is also a state in which the sheet straddles between the conveying path of the fixing conveyance unit 271 and the conveying path of the main body frame of the image forming apparatus 100. It is noted that the image forming apparatus 100 may comprise a door lock mechanism for preventing the front door 275 from being opened by the user. This prevents user's operation of dividing the sheet straddling between the conveying paths into pieces. Further, in a case where the sheet stops in a state in which the sheet straddles between the conveying path of the fixing conveyance unit 271 and the conveying path of the main body frame of the image forming apparatus 100, the image forming apparatus 100 conveys the sheet to a position where it is easily removed. The position where the sheet is easily removed is, for example, a position where the sheet is easily removed by opening the front door 275, the right lower door 260, and the right upper door 261. After conveying the sheet to the position where it is easily removed, the CPU 301 starts the processing shown in FIG. 6.

Figure 7:
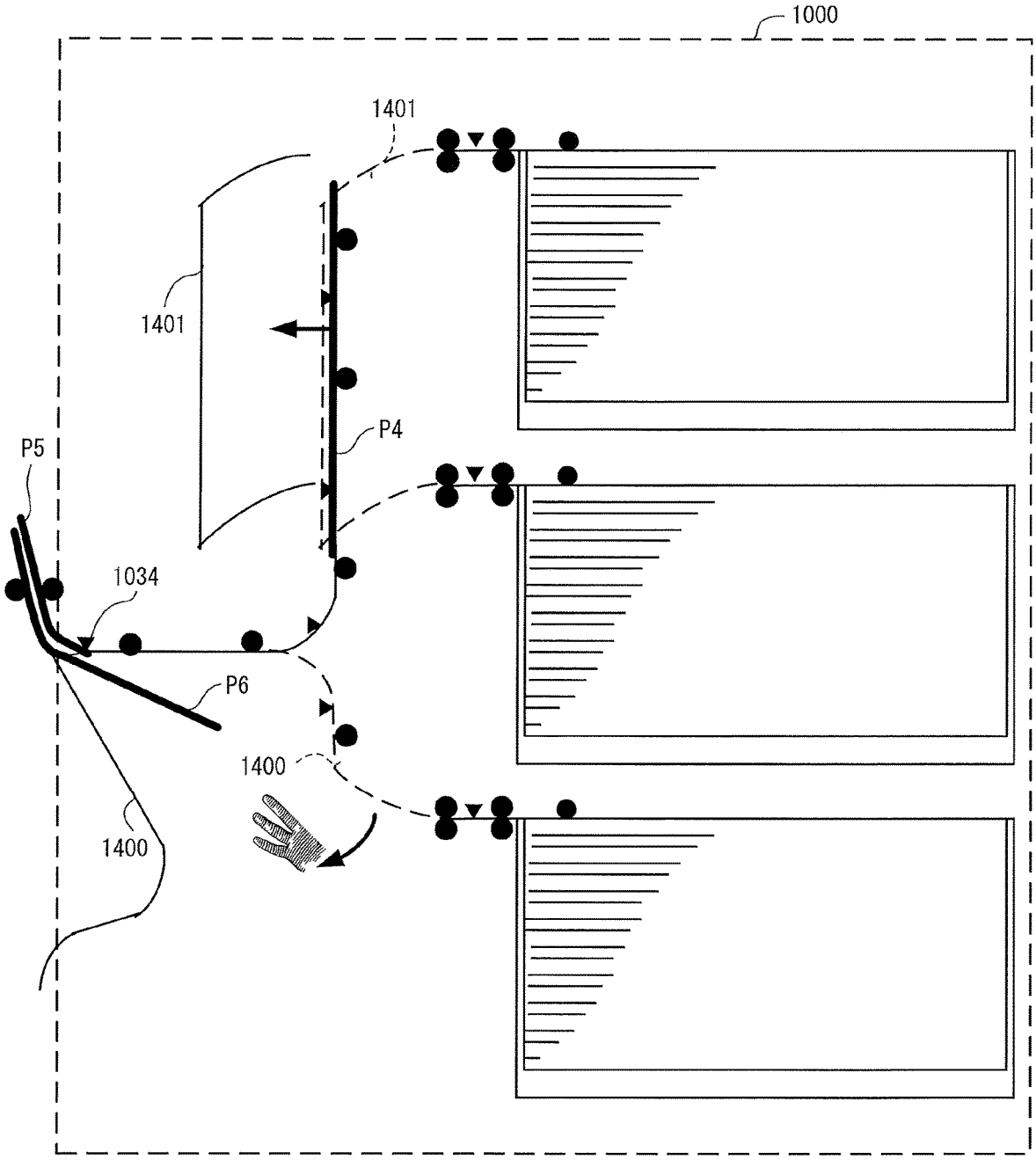
FIG. 7 is an explanatory diagram of a jammed state in the optional deck.
Figure 8:
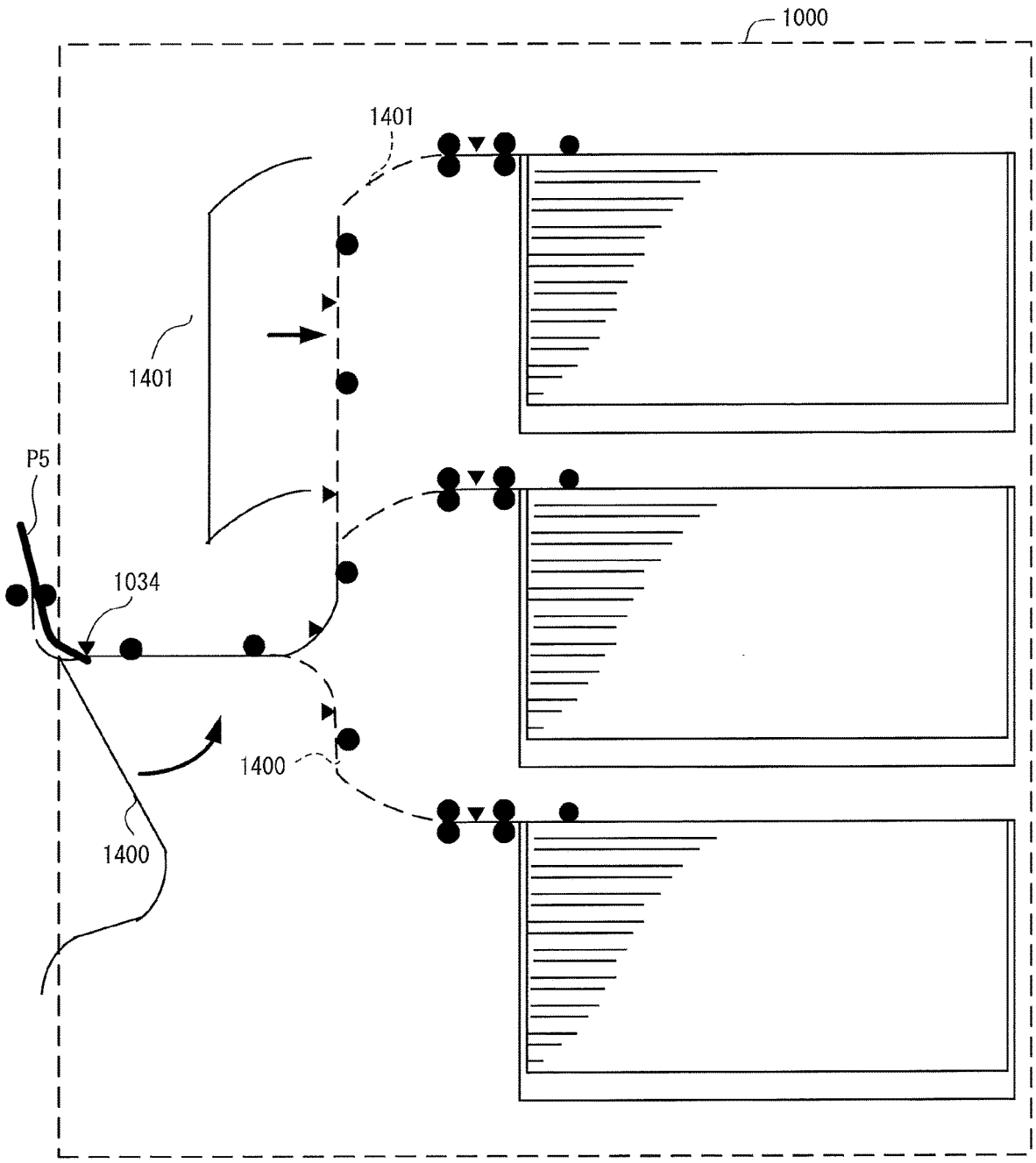
FIG. 8 is an explanatory diagram of the jammed state in the optional deck.
Figure 9:
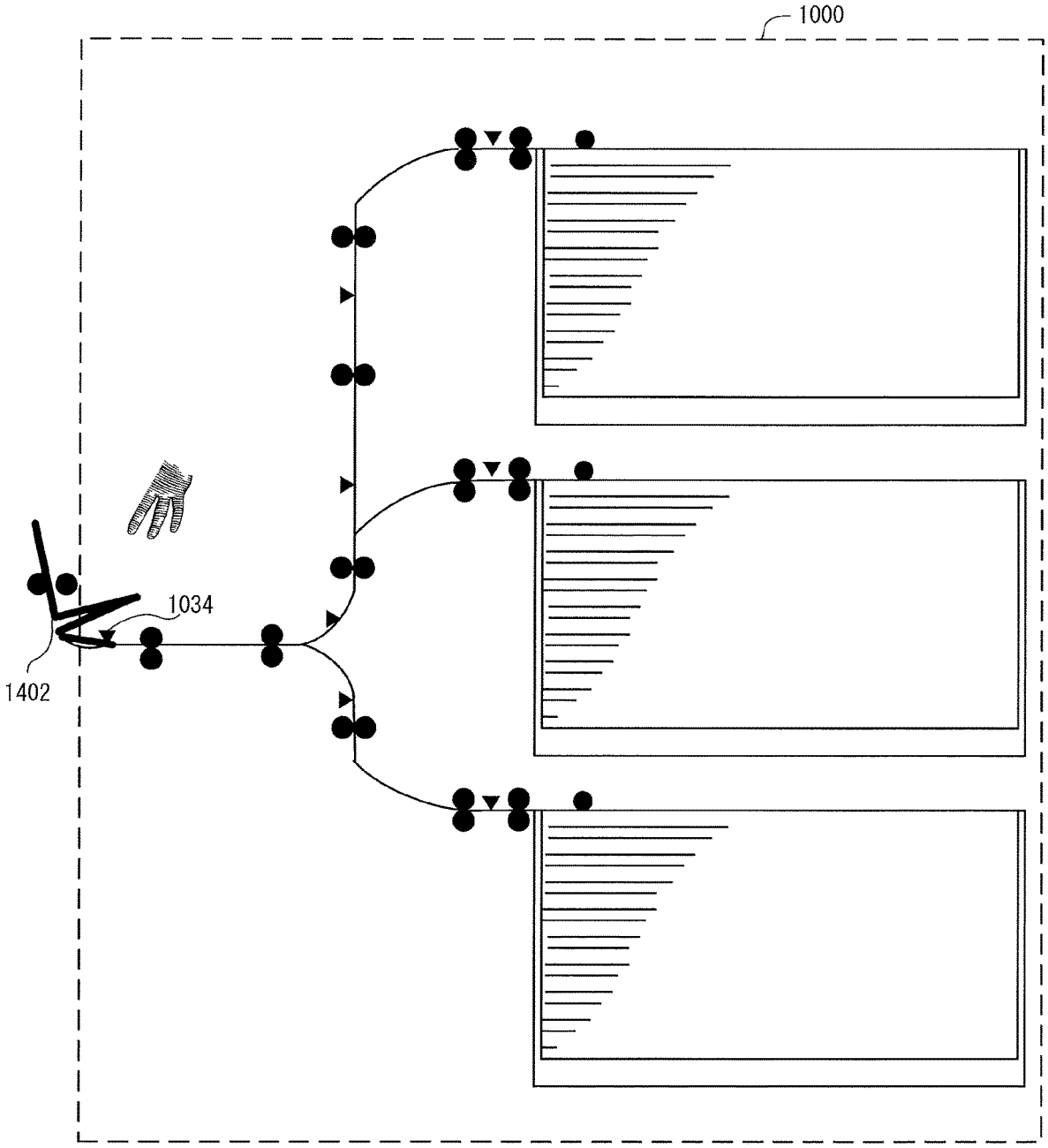
FIG. 9 is an explanatory diagram of the jammed state in the optional deck.

First, a description is provided with regard to the jam processing in a case where, due to the occurrence of the jam, a remaining sheet which is stopped to be conveyed is caused in the optional deck 1000. FIG. 7 to FIG. 9 show the jam state in the optional deck 1000. In FIGS. 7 and 8, a horizontal conveyance guide 1400 in its open state and a vertical path conveyance guide 1401 in its open state are shown in solid lines, and the horizontal conveyance guide 1400 in its closed state and a vertical path conveyance guide 1401 in its closed state are shown in dotted lines.

Figure 10:
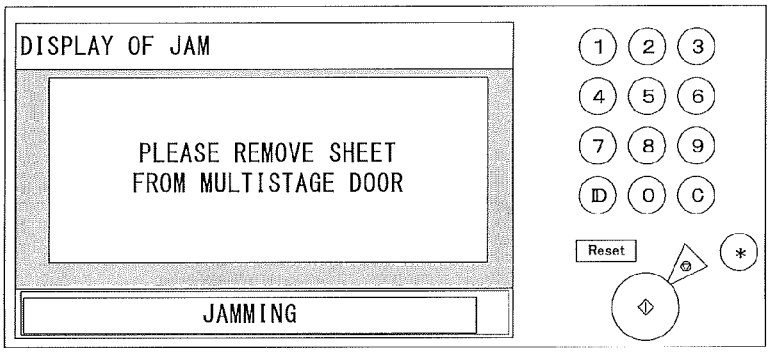
FIG. 10 is an illustration diagram of a jam processing display screen.

When a jam occurs in the optional deck 1000, the CPU 301 displays the jam processing display screen in accordance with a position where the jam has occurred on the UI part 330 (Step S101). For example, as illustrated in FIG. 7, in a case where a plurality of sheets of a sheet P4, a sheet P5 and a sheet P6 remain in the optional deck 1000, through the jam processing display screen illustrated in FIG. 10, the CPU 301 urges the user to perform the jam processing of opening the multistage door 1005 of the optional deck 1000. If the image forming apparatus 100 comprises the door lock mechanism, if "sheet torn off" is likely to be induced, the CPU 301 locks the door.

Here, the jam processing display screen displays a guidance screen which guides to downwardly open a horizontal conveyance guide 1400 to open the common conveying path and the lower stage conveying path to remove the sheet P5 and the sheet P6. FIG. 7 shows a state in which the common conveying path is released and the rear end side of the sheet P6 is hanging downward. Further, the jam processing display screen displays a guidance screen which guides to open a vertical path conveyance guide 1401 in a horizontal direction to open the upper stage conveying path and the middle stage conveying path to remove the sheet P4. In a case where a plurality of sheets are conveyed at the detecting position of the OPT conveyance sensor 1034 but only one sheet can be removed, as shown in FIG. 8, the sheet P5 remains.

When the user removes the sheet in the optional deck 1000 and closes the multistage door 1005, the CPU 301 determines that the opening and thereafter closing of the door in accordance with the jam processing display screen is performed (Step S102: Y). It means that the CPU 301 determines that the jam processing in accordance with the jam processing display screen is performed by the opening/closing of the multistage door 1005 by the user. However, in case of FIG. 8, the OPT conveyance sensor 1034 still detects the sheet. Thereby, the CPU 301 determines that the jam state remains unchanged (Step S103: Y).

If it is determined that the jam state remains unchanged, the CPU 301 determines whether forced sheet feeding is performed or not after displaying the jam processing display screen on the UI part 330 (Step S104). The forced sheet feeding is processing to forcibly convey the sheet remaining due to the occurrence of the jam to a predetermined position where the sheet is easily removed. If it is determined that the forced sheet feeding is not performed (Step S104: N), the CPU 301 performs the forced sheet feeding (Step S105). As shown in FIG. 8, in a case where the sheet P5 remains on the optional deck conveying path 270 which lies between the optional deck 1000 and the image forming apparatus 100, the CPU 301 reversely rotates the conveying roller 158 by reversely driving the pre-registration conveyance motor 507 to perform forced sheet feeding (forced returning). FIG. 9 shows a case where the forced sheet feeding is performed. By executing the forced sheet feeding, the user can easily take out the remaining sheet from a sheet escape outlet 1402 provided on the optional deck conveying path 270.

Figure 11:
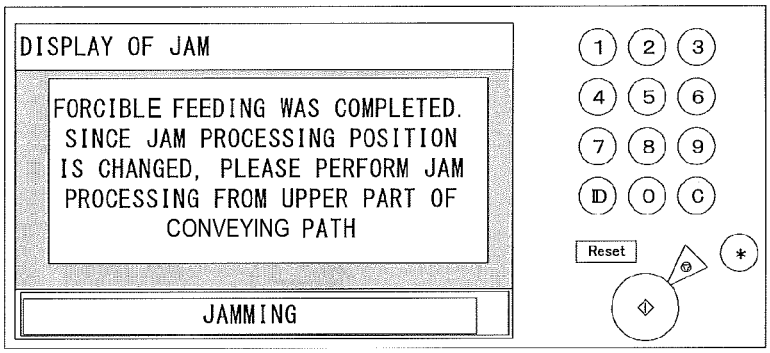
FIG. 11 is an illustration diagram of the jam processing display screen.

After executing the forced sheet feeding, the CPU 301 determines whether it is necessary to change the jam processing display screen or not (Step S106). When the forced sheet feeding is performed, it becomes possible to remove the sheet from the sheet escape outlet 1402 provided on upper part of the conveying path without opening the horizontal conveyance guide 1400. Thereby, the CPU 301 determines that it is necessary to change the jam processing display screen (Step S106: Y). In this case, the CPU 301 updates the jam processing display screen (Step S107). FIG. 11 is an illustration diagram of the updated jam processing display screen. The jam processing display screen shown in FIG. 11 informs the user of a change of the jam processing position.

After updating the jam processing display screen or when it is determined that it is not necessary to update the jam processing display screen (Step S106: N), the CPU 301 determines whether or not the opening/closing of the multistage door 1005 of the optional deck 1000 in accordance with the jam processing display screen is performed (Step S109). If it is determined that the opening/closing of the multistage door 1005 is performed (Step S109: Y), the CPU 301 determines whether the jam state is released or not (Step S110). It means that the CPU 301 determines whether the jam state is released or not based on output of each conveyance sensor after the opening/closing of the multistage door 1005 is performed by the user. If it is determined that the jam state is not released (Step S110: N), the CPU 301 repeatedly performs the processing after Step S103 until the jam state is released. When the jam state is released (Step S110: Y), the CPU 301 ends the jam processing.

Figure 12:
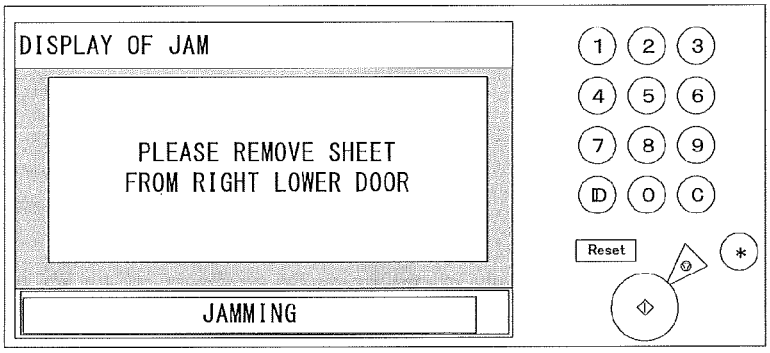
FIG. 12 is an illustration diagram of the jam processing display screen.

It is noted that if it is determined at Step S103 that the jam state is changed (Step S103: N) or if it is determined at Step S104 that the forced sheet feeding is already performed (Step S104: Y), the CPU 301 updates the jam processing display screen to the jam processing display screen urging the next jam processing (Step S108). FIG. 12 is an illustration diagram of the updated jam processing display screen. The jam processing display screen in FIG. 12 urges the user to perform the jam processing of opening the front door 275 of the image forming apparatus 100. It means that the jam processing display screen to the same sheet changes before and after the forced sheet feeding. After updating the jam processing display screen, the CPU 301 performs the processing after Step S109.

If the image forming apparatus 100 comprises the door lock mechanism, the CPU 301 displays the jam processing display screen urging the jam processing of opening the front door 275 as shown in FIG. 12 while releasing the door lock. This allows opening of the front door 275. Further, at the end of the jam processing, the CPU 301 releases the door lock.

Next, a description is provided with regard to the jam processing in a case where the remaining sheet which is stopped to be conveyed is caused in the image forming apparatus 100 due to the occurrence of the jam. FIG. 13 to FIG. 16 show the jam state in the image forming apparatus 100.

Figure 13:
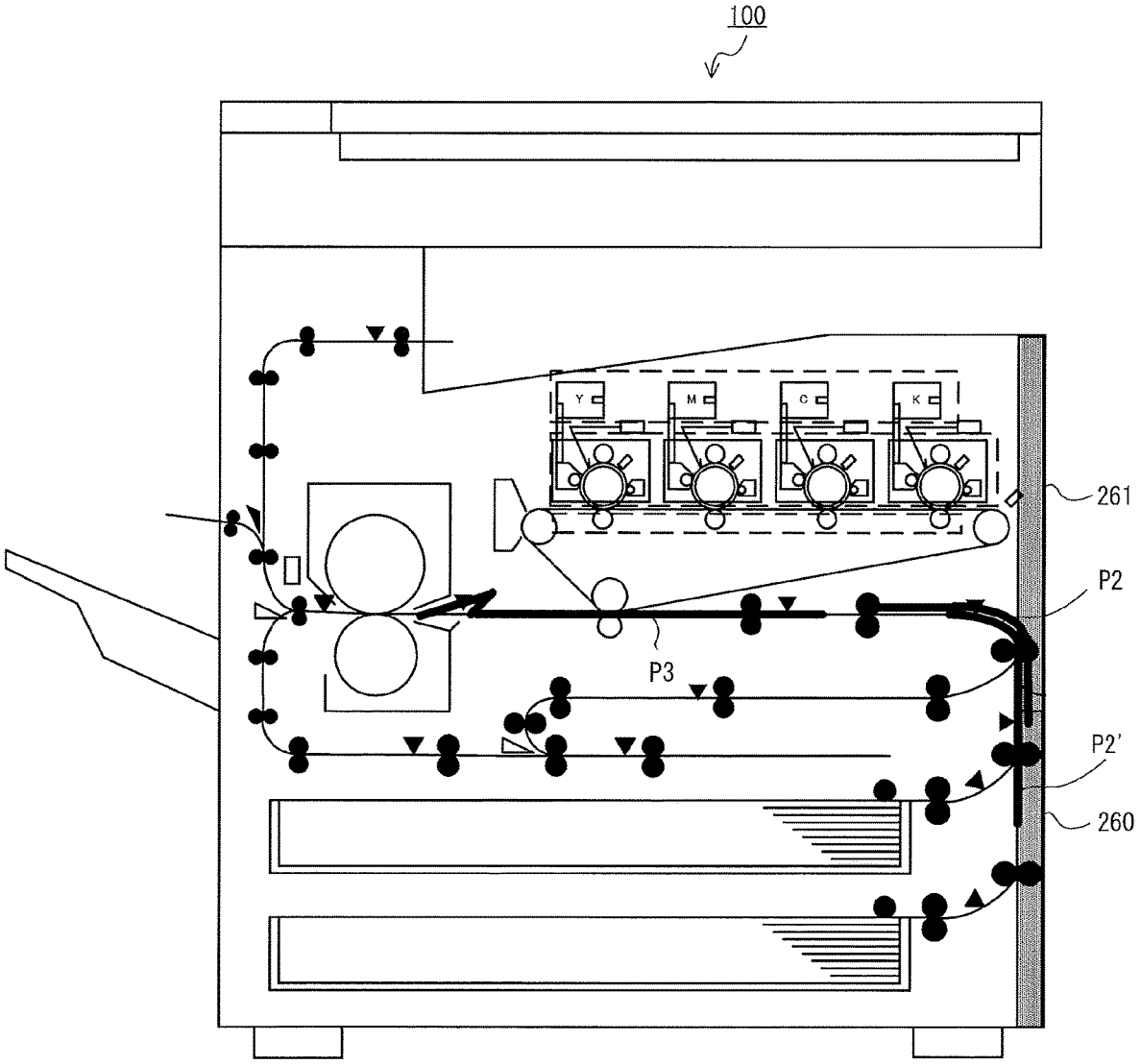
FIG. 13 is an explanatory diagram of the jammed state of an image forming apparatus 100.
Figure 14:
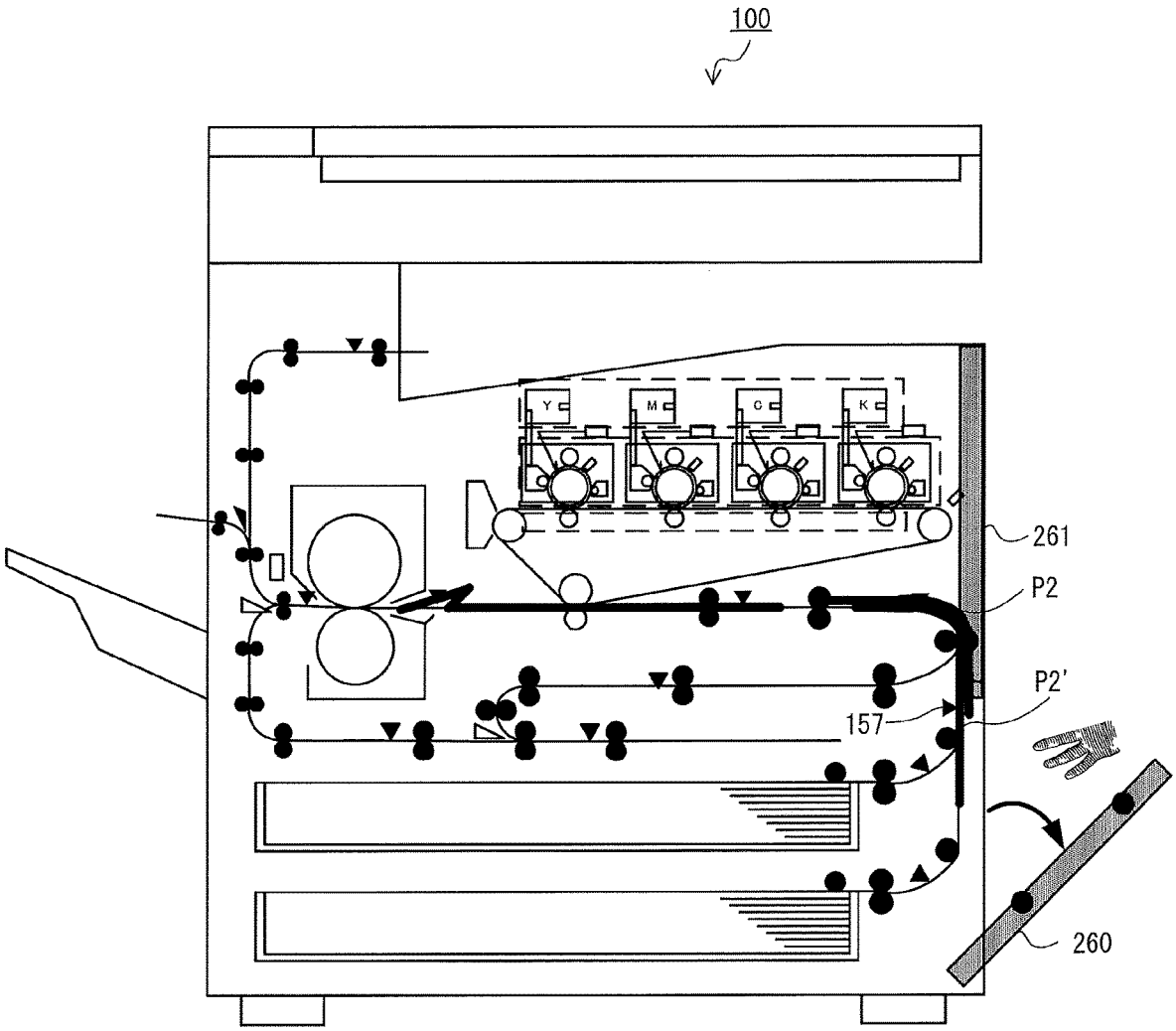
FIG. 14 is an explanatory diagram of the jammed state of the image forming apparatus 100.
Figure 15:
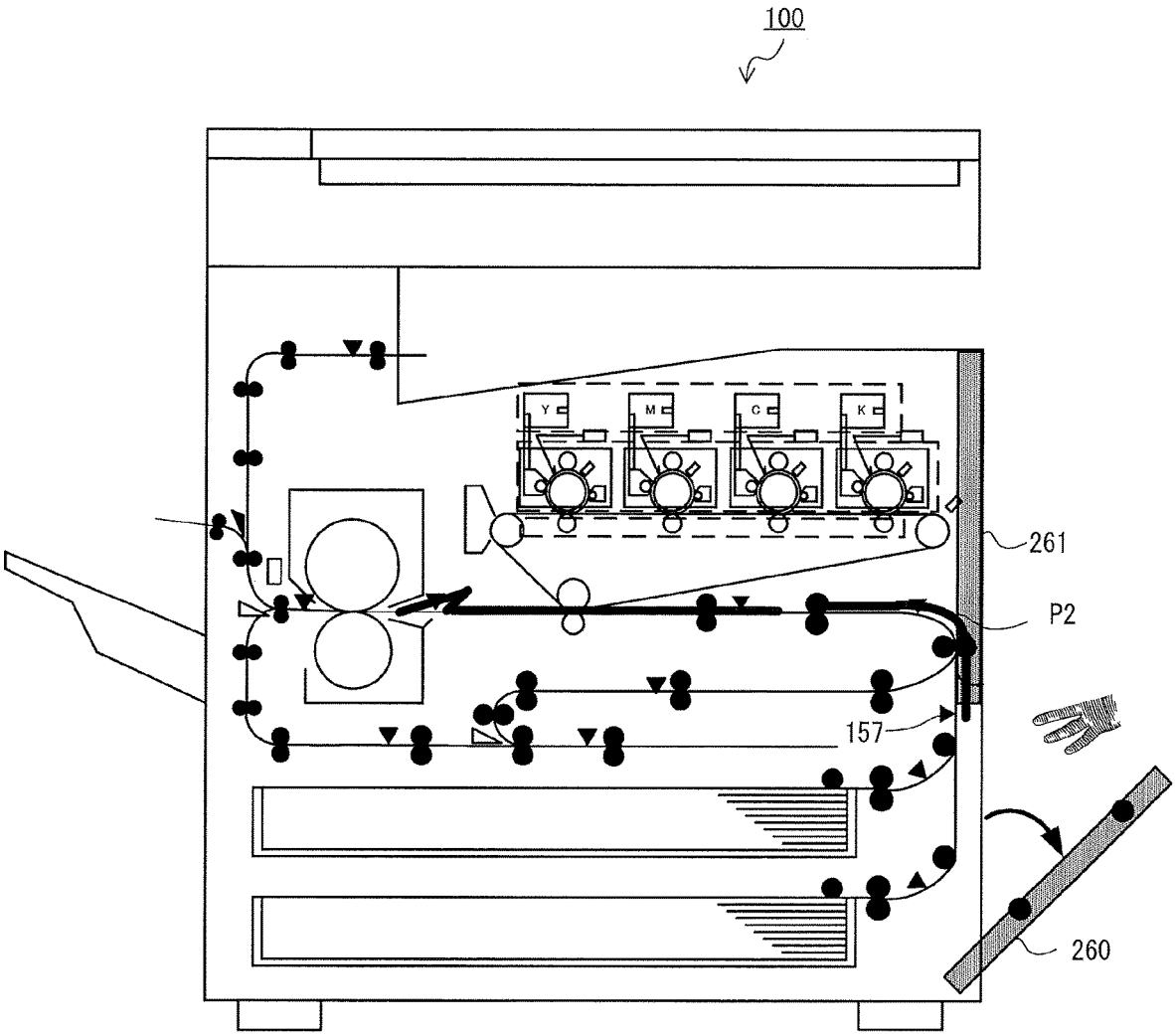
FIG. 15 is an explanatory diagram of the jammed state of the image forming apparatus 100.
Figure 17:
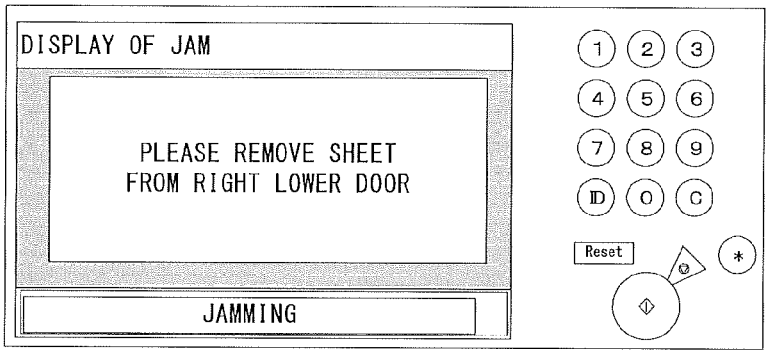
FIG. 17 is an illustration diagram of the jam processing display screen.

When a jam occurs in the image forming apparatus 100, the CPU 301 displays the jam processing display screen in accordance with a position where the jam has occurred on the UI part 330 (Step S101). FIG. 13 shows a state in which the sheet P2 and a sheet P2' are overlappingly fed and the sheet P2 and the sheet P2' are stopped in an overlapped state due to the jam of the sheet P3. As illustrated in FIG. 13, in a case where a plurality of sheets remain in the image forming apparatus 100, through the jam processing display screen as illustrated in FIG. 17, the CPU 301 urges the user to perform the jam processing of opening the right lower door 260 of the image forming apparatus 100. If the image forming apparatus 100 comprises the door lock mechanism, if "sheet torn off" is likely to be induced, the CPU 301 locks the door. As shown in FIG. 14, when the user opens the right lower door 260, the conveying path is uncovered so that the remaining sheet can be removed. Here, in a case where the sheet P2 overlaps with the sheet P2' at the detecting position of the vertical path sensor 157 but the user does not notice the overlapped sheet P2 so that only one sheet (P2') is removed, as shown in FIG. 15, the sheet P2 remains.

In a case where the user removes the sheet in the image forming apparatus 100 and closes the right lower door 260, the CPU 301 determines that the opening and thereafter closing of the door in accordance with the jam processing display screen is performed (Step S102: Y). It means that the CPU 301 determines that the jam processing in accordance with the jam processing display screen is performed by the opening/closing of the right lower door 260 by the user. However, in case of FIG. 15, the vertical path sensor 157 still detects the sheet P2. Thereby, the CPU 301 determines that the jam state remains unchanged (Step S103: Y).

Figure 16:
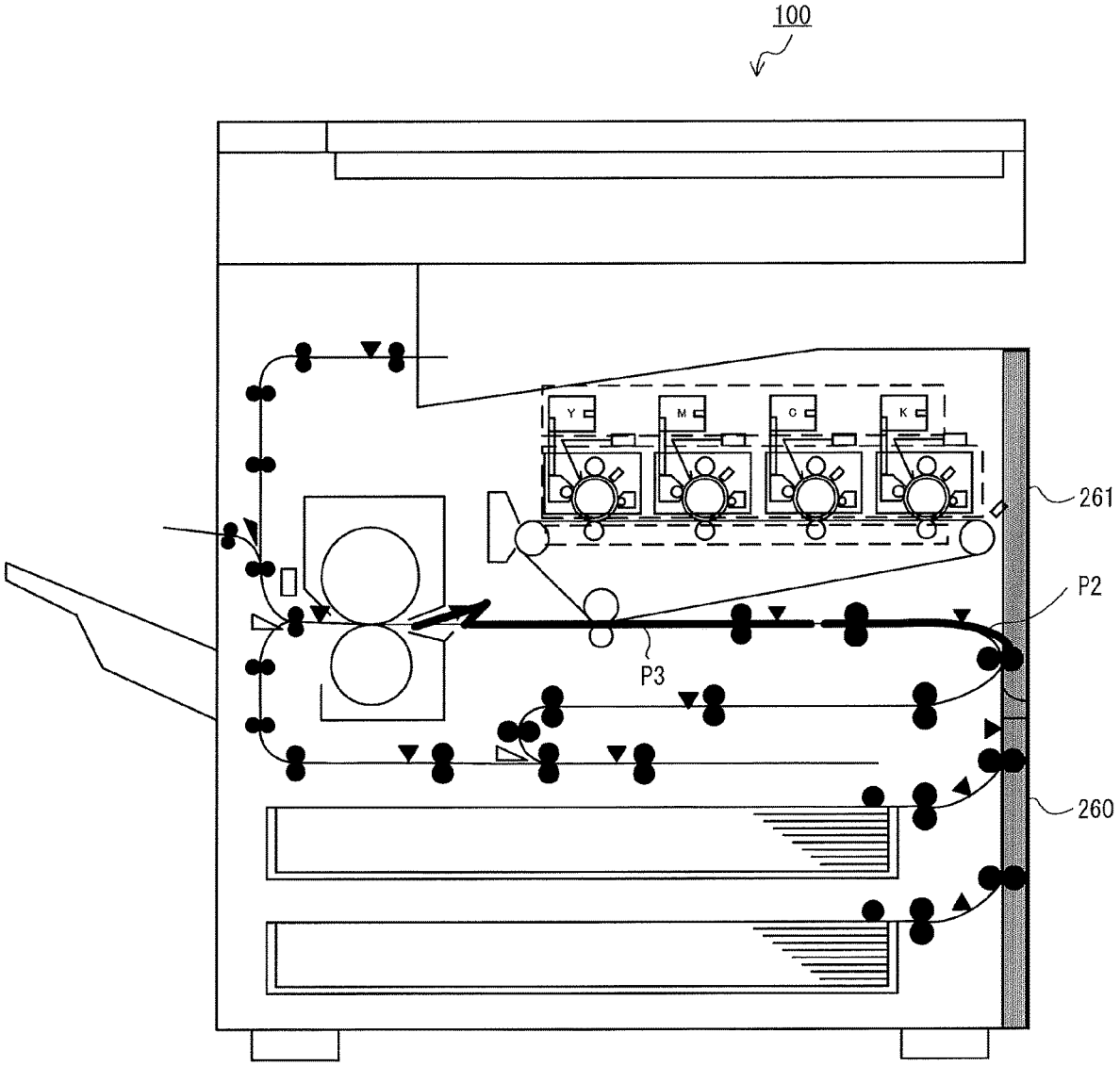
FIG. 16 is an explanatory diagram of the jammed state of the image forming apparatus 100.

If it is determined that the jam state remains unchanged, the CPU 301 determines whether the forced sheet feeding is performed or not after displaying the jam processing display screen on the UI part 330 (Step S104). If it is determined that the forced sheet feeding is not performed (Step S104: N), the CPU 301 performs the forced sheet feeding (Step S105). As shown in FIG. 16, in a case where the sheet P2 remains on an outlet part of the fixing conveyance unit 271 of the image forming apparatus 100, the CPU 301 rotates the conveying roller 158 by driving the pre-registration conveyance motor 507 to perform the forced sheet feeding of the sheet P2. Due to this, the sheet P2 is fed into the fixing conveyance unit 271.

After executing the forced sheet feeding, the CPU 301 determines whether it is necessary to change the jam processing display screen or not (Step S106). As shown in FIG. 16, in a case where the forced sheet feeding of the sheet P2 is performed, the sheet P2 should be removed by drawing out the fixing conveyance unit 271. By opening the front door 275, the fixing conveyance unit 271 can be drawn out from the main body of the image forming apparatus 100. At this time, the UI part 330 has given an instruction to open the right lower door 260 so that it is necessary to update the jam processing display screen to the jam processing display screen urging to open the front door 275. Thereby, the CPU 301 determines that it is necessary to change the jam processing display screen (Step S106: Y). The CPU 301 updates the jam processing display screen (Step S107). FIG. 12 is an illustration diagram of the updated jam processing display screen. The jam processing display screen in FIG. 12 informs the user of the change of the jam processing position.

After updating the jam processing display screen or when it is determined that it is not necessary to update the jam processing display screen (Step S106: N), the CPU 301 determines whether or not the opening and thereafter closing of the front door 275 of the image forming apparatus 100 in accordance with the jam processing display screen is performed (Step S109). If it is determined that the opening and thereafter closing of the front door 275 is performed (Step S109: Y), the CPU 301 determines whether the jam state is released or not (Step S110). It means that the CPU 301 determines whether or not the jam processing in accordance with the jam processing display screen is performed by the opening/closing of the front door 275 by the user. If it is determined that the jam state is not released (Step S110: N), the CPU 301 repeatedly performs the processing after Step S103 until the jam state is released. When the jam state is released (Step S110: Y), the CPU 301 ends the jam processing.

It is noted that if it is determined at Step S103 that the jam state is changed (Step S103: N) or if it is determined at Step S104 that the forced sheet feeding is already performed (Step S104: Y), the CPU 301 updates the jam processing display screen to the jam processing display screen urging the next jam processing (Step S108). FIG. 12 is an illustration diagram of the updated jam processing display screen. The jam processing display screen in FIG. 12 urges the user to perform the jam processing of opening the front door 275 of the image forming apparatus 100. After updating the jam processing display screen, the CPU 301 performs the processing after Step S109.

If the image forming apparatus 100 comprises the door lock mechanism, when the CPU 301 displays the jam processing display screen urging the jam processing of opening the front door 275 as shown in FIG. 12, the door lock is released. Further, at the end of the jam processing, the CPU 301 releases the door lock.

As mentioned, the image forming apparatus 100 of the present embodiment urges the user to perform appropriate processing based on jam processing procedure while executing the forced sheet feeding at appropriate timing. Thereby, the image forming apparatus capable of easily performing the jam processing is realized without increasing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-128924, filed Jun. 29, 2016, which is hereby incorporated by reference herein in its entirety.

What is claimed is:

1. An image forming apparatus comprising:

a conveyer configured to convey sheets on a conveying path;

a jam detector configured to detect a jam of a sheet which is conveyed by the conveyer;

a door to be opened when removing the sheet from the conveying path, a display configured to display information; and a controller configured to perform control for jam processing if a first jam of a first sheet is detected by the jam detector, wherein the controller performs the following functions:

a first display function to display first jam processing information on the display, the first jam processing information representing a processing procedure for releasing the first jam in accordance with a position where the first jam occurs;

a forcible feeding function to forcibly convey the first sheet to a predetermined position by the conveyer if, after the door is opened and then closed for releasing the first jam in accordance with the first jam processing information, a state of the first jam remains unchanged; and a second display function to display second jam processing information on the display, the second jam processing information representing a processing procedure for releasing the first jam in accordance with the predetermined position after the first sheet is conveyed by the forcible feeding function.

2. The image forming apparatus according to claim 1, further comprising:

a drawer unit comprising a first conveying path to be drawn out from the image forming apparatus with a first door, from among a plurality of doors, being opened; and a second conveying path arranged outside the drawer unit and connected to the first conveying path, wherein, in a case where the first sheet stops straddling between the first conveying path and the second conveying path during occurrence of a jam, the controller is further configured to convey the first sheet to the predetermined position after a second door, which is opened when removing the first sheet from the second conveying path, is opened and then closed.

3. The image forming apparatus according to claim 2, further comprising:

a lock mechanism configured to prevent the first door from being opened, wherein the controller is further configured to control the lock mechanism to prevent the first door from being opened in a case in which the first sheet stops straddling between the first conveying path and the second conveying path during occurrence of the first jam.

4. The image forming apparatus according to claim 3, wherein the controller is further configured to control the lock mechanism to allow opening of the first door for releasing the first jam after the first sheet is conveyed, by the forcible feeding function, to a predetermined position where the sheet does not straddle between the first conveying path and the second conveying path.

5. The image forming apparatus according to claim 1, wherein the controller further performs a third display function to display third jam processing information on the display, the third jam processing information representing, after the processing for releasing the first jam in accordance with the first jam processing information is performed, if a state of the first jam is changed, a processing procedure for releasing the first jam in accordance with a state of the first jam which is changed.

6. A jam processing method performed by an image forming apparatus comprising a plurality of detectors for detecting a sheet which is conveyed along a conveying path and a door which is to be opened when removing the sheet from the conveying path, the method comprising:

detecting an occurrence of a first jam of a first sheet at detection timing of the sheet at a first detector and a second detector and informing of first jam processing information representing a processing procedure for releasing the first jam in accordance with a position where the first jam occurs; and after the door is opened and then closed for releasing the first jam in accordance with the first jam processing information, if a state of the first jam remains unchanged, forcibly conveying the first sheet to a predetermined position, and informing of second jam processing information representing a processing procedure for releasing the first jam in accordance with the predetermined position after the first sheet is forcibly conveyed.

7. The jam processing method according to claim 6, wherein the image forming apparatus comprises a unit comprising a first conveying path which can be drawn out from the image forming apparatus by opening a first door from among a plurality of doors and a second conveying path which is arranged outside the unit and connects to the first conveying path, and wherein the image forming apparatus is further configured to convey, in a case in which the first jam occurs due to stopping of the first sheet straddling between the first conveying path and the second conveying path, the first sheet to the predetermined position after a second door which is opened when removing the first sheet from the second conveying path is opened and then closed.

8. The jam processing method according to claim 7, wherein the image forming apparatus is further configured, in a case in which the first jam occurs due to stopping of the first sheet straddling between the first conveying path and the second conveying path, to prevent the first door from being opened.

9. The jam processing method according to claim 8, wherein the image forming apparatus is further configured, after the first sheet is conveyed to a predetermined position where the first sheet does not straddle between the first conveying path and the second conveying path, to allow opening of the first door for releasing the first jam.

10. The jam processing method according to claim 6, further comprising informing of third jam processing information representing, after the processing for releasing the first jam in accordance with the first jam processing information is performed, if a state of the first jam is changed, a processing procedure for releasing the first jam in accordance with a state of the first jam which is changed.

* * * * *